US012286840B2

(12) United States Patent
McGuigan et al.

(10) Patent No.: US 12,286,840 B2
(45) **Date of Patent: *Apr. 29, 2025**

(54) FIBER OPTIC ENABLED INTELLIGENT COMPLETION EMPLOYING AN END CONNECTOR

(71) Applicant: Halliburton Energy Services, Inc., Houston, TX (US)

(72) Inventors: Brian Patrick McGuigan, Houston, TX (US); Glenn Wilson, Houston, TX (US); Seth Cormier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/300,882

(22) Filed: Apr. 14, 2023

(65) Prior Publication Data

US 2023/0332471 A1 Oct. 19, 2023

Related U.S. Application Data

(60) Provisional application No. 63/331,185, filed on Apr. 14, 2022.

(51) Int. Cl.
*E21B 17/02* (2006.01)
*E21B 33/12* (2006.01)
(Continued)

(52) U.S. Cl.
CPC ..... *E21B 17/028* (2013.01); *E21B 34/06* (2013.01); *E21B 43/14* (2013.01); *E21B 47/01* (2013.01); *E21B 47/114* (2020.05); *E21B 33/12* (2013.01)

(58) Field of Classification Search
CPC ..... E21B 49/0875; E21B 43/12; E21B 34/06; E21B 47/06; E21B 47/07; E21B 43/38;
(Continued)

(56) References Cited

U.S. PATENT DOCUMENTS

| | | | |
|---|---|---|---|
| 8,925,631 | B2 | 1/2015 | Patel |
| 2016/0024916 | A1 | 1/2016 | de Oliveira et al. |
| 2019/0249531 | A1 | 8/2019 | Wright et al. |

FOREIGN PATENT DOCUMENTS

| | | | |
|---|---|---|---|
| AU | 2012386592 | * | 1/2015 |
| CA | 2397819 A1 | * | 8/2001 |

(Continued)

*Primary Examiner* — Zakiya W Bates
(74) *Attorney, Agent, or Firm* — Scott Richardson; Parker Justiss, P.C.

(57) ABSTRACT

A well system and a related method are discussed. The well system, in one aspect, includes a wellbore extending through a subterranean hydrocarbon producing zone, as well as production tubing located in the wellbore, the production tubing including a first inflow control valve configured to regulate a first inflow of hydrocarbons from the subterranean hydrocarbon producing zone into the production tubing. The well system, in accordance with this aspect, further includes a flange coupled to the production tubing and having a fitting positioned proximate a downhole end thereof, and a fiber optic cable installed within the wellbore, an end connector of the fiber optic cable coupled end to end with the fitting of the flange to fix the fiber optic cable relative to the first inflow control valve.

19 Claims, 8 Drawing Sheets

(51) Int. Cl.

| | |
|---|---|
| ***E21B 34/06*** | (2006.01) |
| ***E21B 43/14*** | (2006.01) |
| ***E21B 47/01*** | (2012.01) |
| ***E21B 47/113*** | (2012.01) |

(58) Field of Classification Search
CPC ..... E21B 43/14; E21B 33/12; E21B 47/01; E21B 43/34
See application file for complete search history.

(56) References Cited

FOREIGN PATENT DOCUMENTS

| | | | | | |
|---|---|---|---|---|---|
| CA | 2546164 | C | * | 9/2009 | ..... E21B 43/128 |
| GB | 2403292 | A | | 12/2004 | |
| WO | 2015030846 | A1 | | 3/2015 | |

* cited by examiner

FIBER OPTIC ENABLED INTELLIGENT COMPLETION EMPLOYING AN END CONNECTOR

CROSS-REFERENCE TO RELATED APPLICATION

This application claims the benefit of U.S. Provisional Application Ser. No. 63/331,185, filed on Apr. 14, 2022, entitled "FIBER OPTIC ENABLED INTELLIGENT COMPLETION," commonly assigned with this application and incorporated herein by reference in its entirety.

BACKGROUND

There is a need for greater data resolution in multi-zone intelligent well completions, such as SmartWell® systems. Currently quartz-based and piezo-based electric sensors give well operators discrete spatiotemporal pressure and temperature data by installing sensors at varying intervals, but any analysis outside of pressure and temperature readings at those fixed locations has to be modeled to calculate values at depths or intervals where no sensors exist. Additionally, the distributed pressure and temperature offerings require a minimum distance between sensors, which prohibits more than one or two discreet sensing locations per zone in a typical SmartWell® assembly.

BRIEF DESCRIPTION

Reference is now made to the following descriptions taken in conjunction with the accompanying drawings, in which.

DETAILED DESCRIPTION

Figure 1:
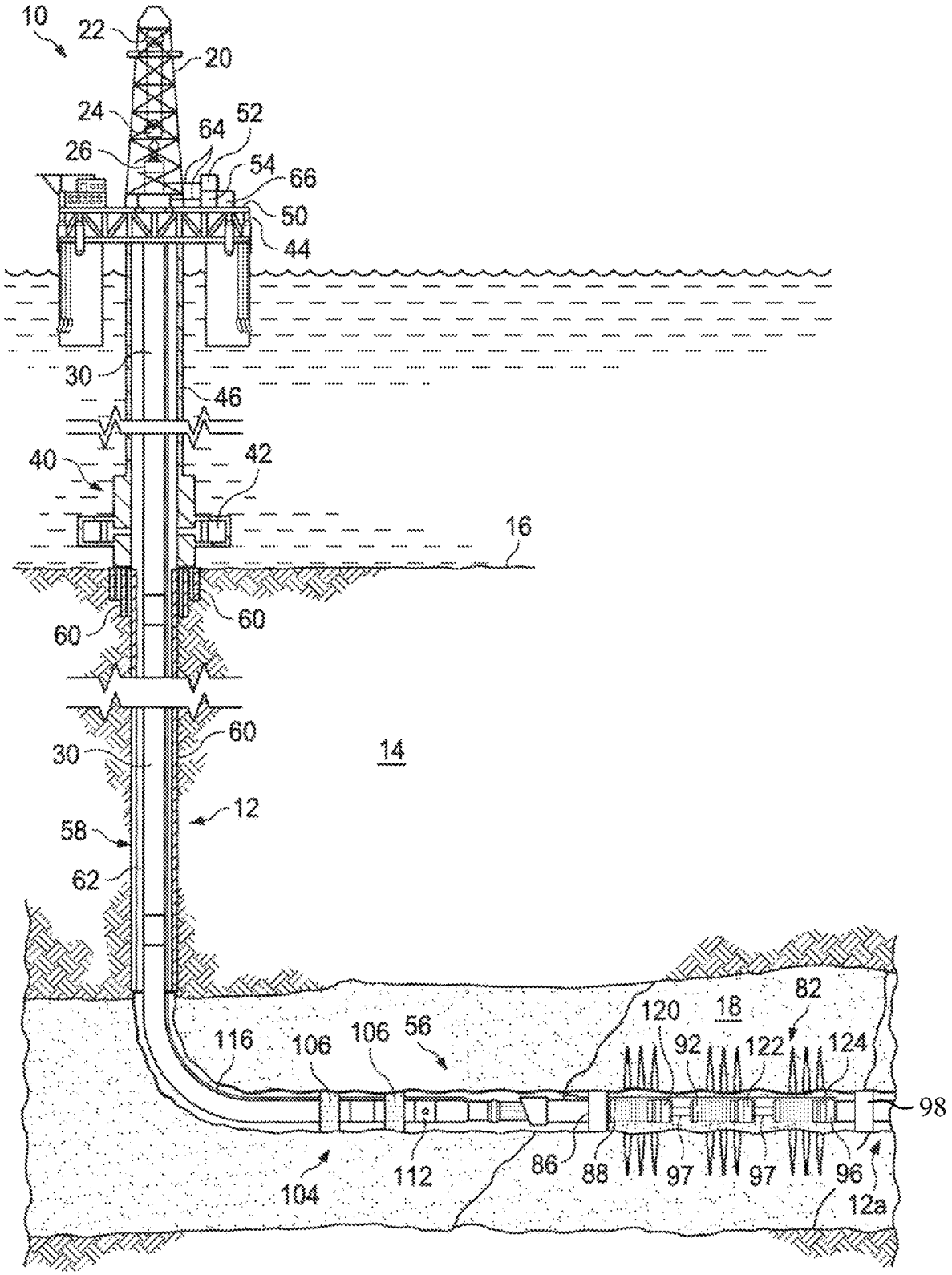
FIG. 1 illustrates a well system designed, manufactured, and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Disclosed herein, is a fiber optic enabled or intelligent completion, such as Halliburton's SmartWell® system. The method and associated components will allow the operator to collect zonal allocation and flow characteristics in both producer and injector applications by installing a tubing encapsulated fiber optic (TEF) cable or a tubing encapsulated conductor and fiber optic (TECF) cable across inflow devices using feedthrough ports in one or more feedthrough packers. TEF and TECF cables may generally be referred to as a fiber optic cable or a downhole fiber optic cable. The one or more optical fibers contained within the fiber optic cable are typically referred to as sensing fibers.

For dry-tree wells where the downhole fiber optic cable is fed through the dry-tree via an appropriate well head exit (WHE) or well head outlet (WHO), the downhole fiber optic cables typically contain a plurality of single-mode and multi-mode optical fibers such that Rayleigh-based distributed acoustic sensing (DAS) and Raman-based distributed temperature sensing (DTS), which can be operated on single- and multi-mode fiber respectively. Single-mode fibers may be processed during their manufacture to generate higher-than-Rayleigh backscatter signals for improving Rayleigh backscatter signal-to-noise sensing performance.

Brillouin-based distributed temperature and/or strain sensing (DTS/DSS) can also be operated on an available single-mode fiber. In some embodiments, Brillouin-based DTS/DSS can be simultaneously operated on the same available single-mode fiber as Rayleigh-based DAS by combing the Rayleigh and Brillouin interrogation units via an appropriate wavelength division multiplexer (WDM).

Discrete fiber optic sensors can be formed from fiber Bragg gratings (FBG) in either single- or multi-mode fibers that measure discrete temperature and/or strain. FBGs can be integrated to an appropriate transducer assembly for the measurement of discrete temperature and pressure, e.g., an FBG-based pressure and temperature gauge. One or more FBG-based pressure and temperature gauges can be integrated in-line or terminating the fiber optic cable.

In some embodiments, FBG-based pressure and temperature sensing can be simultaneously operated on the same available single-mode fiber as Rayleigh-based DAS by combing the Rayleigh and FBG interrogation units via an appropriate WDM. In other embodiments, FBG-based pressure and temperature sensing and Brillouin-based DTS/DSS can be simultaneously operated on the same available single-mode fiber as Rayleigh-based DAS by combing the Rayleigh, Brillouin, and FBG interrogation units via an appropriate WDM. Note that Rayleigh, Brillouin, FBG, and Raman interrogation units may each or collectively be referred to as one or more fiber optic interrogation units.

Dry-tree wells are completed both onshore and offshore. Typically, the fiber optic interrogation units are located proximal to the well head, and are optically coupled to the optical fibers exiting the WHE/WHO via an appropriate surface fiber optic cable. However, in some embodiments, the fiber optic interrogation units are distant from the well head, and are optically coupled to the optical fibers existing the WHE/WHO via a fiber optic network that may be inclusive of one or more transmission fibers, circulators (or their functional equivalents), or WDMs (or their functional equivalents). For example, a proximal circulator may be used to optically couple a fiber optic interrogation unit to down-going and up-going transmission fibers; which are optically coupled to a distal (or remote) circulator which is further coupled to a sensing fiber. This enables the fiber optic interrogation system to operate with the same optical pulse repetition rates as if it were located proximal to the well head.

For subsea wells, the fiber optic cables typically contain one or more single-mode optical fibers, and are utilized for Rayleigh-based DAS, Brillouin DTS/DSS, and FBG sensing. The number of downhole sensing fibers is constrained by the number of fibers available in the optical feedthrough system (OFS) that provides optical continuity between the downhole sensing fibers and the subsea optical distribution system. In some embodiments, the subsea optical distribution may couple to one or more marinized fiber optic interrogation units. In other embodiments, the subsea optical distribution may couple to topside or onshore fiber optic interrogation units via a subsea a fiber optic network that may be inclusive of one or more transmission fibers, circulators (or their functional equivalents), or WDMs (or their functional equivalents). For example, a proximal circulator may be used to optically couple a fiber optic interrogation unit to down-going and up-going transmission fibers; which are optically coupled to a distal (or remote) circulator which is further coupled to a sensing fiber. This enables the fiber optic interrogation system to operate with the same optical pulse repetition rates as if it were located proximal to the subsea tree.

The disclosure is applicable to the completions of dry-tree wells completed either onshore or offshore, and to the completions of subsea wells. The disclosure, in at least one embodiment, will integrate fiber optic cables across one or more zonal inflow devices by employing a feedthrough packer feature (e.g., existing feed through packer feature) to allow the fiber optic cable to span all or a portion of an entire length of the zone. In one embodiment, this will place the fiber optic cable across the inflow/outflow device, which during injection or production will create a low-level temperature and/or acoustic signals that will allow the operator to gain valuable production or injector diagnostic data from each isolated zone. When a shrouded device is employed, in one embodiment the new system will employ a similar feedthrough port. These ports, in certain embodiments, will allow the operator to maintain hydraulic integrity of each zone by using pressure testable fittings at each penetration.

In both shrouded and unshrouded devices, the fiber optic cable may need to be secured, for example to prevent unwanted movement of the cable that will be subjected to the flow in or out of the zone in which it is exposed.

The integration of fiber optic cable across multiple zones of an intelligent completion will give well operators much greater temperature data resolution by allowing them to interrogate temperature via DTS at any given point along the fiber optic cable up to the end of fiber or termination; rather than at one or more discrete locations when using a fiber optic or electric pressure and temperature gauge. Moreover, the same fiber optic cable will give well operators acoustic data by allowing them to interrogate acoustics (or vibration) via DAS at any given point along the fiber optic cable up to the end of fiber at the termination. As part of this system, in one embodiment an anchoring feature (FIGS. 3A-3E) is provided to the end of fiber termination, which would allow the operator to secure the end of fiber inside of a shrouded inflow device to maintain the cable position within the zone of interest.

The analysis of DAS and DTS measurements across, and one or more discrete pressure and temperature in, one or multiple zones will allow well operators to determine well performance, such as inflow or outflow from a give zone, and/or gas/liquid/solid characteristics. Such analysis can be calibrated during well testing operations. The advantage of such analysis based on permanently installed (e.g., without intervention) fiber optic cables is that it may reduce or eliminate the requirements for well logging via interventions as are currently performed to evaluate well performance.

The use of feedthrough ports in zonal inflow devices and packers may help eliminate the use of optical wet-mate devices and related completions systems otherwise needed to optically couple two fiber optic cables, and alternatively allow operators to hard wire the fiber optic connection from the lowest zone to the fiber optic interrogation unit.

The system described, in at least one embodiment, will give well operators greater information and allow for a more robust analysis of each well's productivity, whether the well is used for production or injection. The enhanced datastream from a single well can also be employed to improve models being used in other wells within the same area and/or reservoir to achieve a greater understanding of their field. To date, operators have limited fiber optic installations above the production packer, and may use the various types of data for applications such as leak detection, gas lift optimization, and vertical seismic profiling (VSP).

Continuous DAS measurement and analysis for induced seismic activity created by produced and/or injected fluids, e.g., cap rock integrity or out of zone injection (OOZI), can reduce or eliminate the need for well operators to periodically utilize seismic sources (e.g., VibroSeis, marine vibrators, air guns) to acquire VSP data. Depending on the depth of the zonal inflow device with respect to the reservoir, baseline or monitor VSP surveys may also be able to allow operators to monitor geological formations over time, e.g., fluid substitution within the reservoir, and enable proactive (rather than reactive) reservoir management practices.

Currently, well operators are limited to utilizing "virtual" flow metering or venturi flowmeters that introduce an internal diameter (ID) restriction into the tubing that can be difficult to retrieve or cause costly interventions if the venturi flowmeter needs to be removed to access the wellbore below the restriction. By placing the fiber optic cable across the zone and inflow device, there will be no impact to the tubing ID, thus not creating a restriction for the event that intervention below the given zone is required.

The fiber optic cable, end termination, splices, and associated accessories employed according to this disclosure are saleable items that have reliable results in situations other than the intelligent completion market disclosed herein.

There is also a service revenue stream associated with the installation, testing, and acquisition of fiber optic data. Even where the operator of a given well chooses to utilize a hybrid electro-optical cable rather than a dedicated TEF, the market value of a hybrid cable is greater than the value of the TEC sold today without fiber incorporated.

Turning to FIG. 1, shown is an elevation view in partial cross-section of a well system 10 employed to complete wells intended to produce hydrocarbons from wellbore 12 extending through various earth strata in an oil and gas formation 14 located below the earth's surface 16. Wellbore 12 may be formed of a single or multiple bores, extending into the formation 14, and disposed in any orientation, such as the horizontal wellbore 12*a* illustrated in FIG. 1. Formation 14 includes production zones 18 from which hydrocarbons are produced.

Well system 10 includes a rig or derrick 20. Rig 20 may include a hoisting apparatus 22, a travel block 24, and a swivel 26 for raising and lowering casing, drill pipe, coiled tubing, production tubing, other types of pipe or tubing strings 30 or other types of conveyance vehicles such as wireline, slickline, and the like. In FIG. 1, shown is a substantially tubular, axially extending work string or production tubing 30, formed of a plurality of pipe joints coupled together end-to-end supporting a completion assembly as described below.

Rig 20 may be located proximate to or spaced apart from wellhead 40, such as in the case of an offshore arrangement as shown in FIG. 1. One or more pressure control devices 42, such as blowout preventers (BOPs), and other equipment associated with drilling or producing a wellbore may also be provided at wellhead 40 or elsewhere in well system 10.

For offshore operations, as shown in FIG. 1, rig 20 may be mounted on an oil or gas platform 44, such as the offshore platform as illustrated, semi-submersibles, drill ships, and the like (not shown). Although the well system 10 of FIG. 1 is illustrated as being a marine-based well system, well system 10 of FIG. 1 may be deployed on land. In any event, for marine-based systems, one or more subsea conduits or risers 46 extend from deck 50 of platform 44 to a subsea wellhead 40. Tubing string 30 extends down from rig 20, through subsea conduit 46 and BOP 42 into wellbore 12. A working or service fluid source 52, such as a storage tank or vessel, may supply, via flow lines 64, a working fluid to equipment disposed in wellbore 12, such as subsurface equipment 56. Working fluid source 52 may supply any fluid utilized in wellbore operations, including without limitation, gravel packing slurry, acidizing fluid, liquid water, steam or some other type of fluid.

Well system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as tubing string 30, conduit 46, and casing. In this regard, pipe system 58 may include one or more casing strings 60 that may be cemented in wellbore 12, such as the surface, intermediate and production casings, 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be. While wellbore 12 is shown as uncased in the production zone 18 and along the entire depicted portion of horizontal wellbore 12*a*, all or a portion of wellbore 12 and/or horizontal wellbore 12*a* may be cased as well and the disclosure is not limited in that regard.

Production fluids and other debris returning to surface 16 from wellbore 12 are directed by a flow line 64 to storage tanks 54 and/or processing systems 66. As shown in FIG. 1, subsurface equipment 56 is illustrated as completion equipment and tubing string 30 in fluid communication with the completion equipment 56 is illustrated as production tubing 30. Although completion equipment 56 can be disposed in a wellbore 12 of any orientation, for purposes of illustration, completion equipment 56 is shown disposed in a substantially horizontal portion of wellbore 12 and includes a lower completion assembly 82 having various tools such as a packer 86, a sand screen assembly 88, a sand screen assembly 92, a sand screen assembly 96 and a packer 98. In embodiments where lower completion assembly 82 is deployed in a cased wellbore, an additional packer, such as packer 86, would be deployed at the distal end of the lower completion assembly. In the illustrated embodiment, packer 86 is generally located adjacent the upstream or proximal end of a production zone 18 and packer 98 is generally located adjacent the downstream or distal end of a production zone 18. Sand screen assemblies 88, 92 and 96 each may include a shunt tube system 97.

In the illustrated embodiment, the one or more of sand screen assemblies 88, 92 and 96 include an adjustable flow control node 120, 122, 124 (e.g., electronic flow control node), respectively, that can be employed to inject working fluids from working fluid source 52 into the annulus 62 around sand screen assemblies 88, 92 and 96. In some embodiments, the one or more flow control nodes 120, 122, 124 may be employed to control flow of fluid through shunt tube systems 97.

Disposed in wellbore 12 at the lower end of tubing string 30 is an upper completion assembly 104 that includes various tools such as a packer 106, and a fluid flow control module 112. Extending uphole from upper completion assembly 104 are one or more lines 116, such as hydraulic tubing, pressurized fluid tubing, electric cable and the like which extend to the surface 16 and can be utilized for control of upper completion assembly 104 and lower completion assembly 82. In one or more embodiments, the lines 116 extent to fluid flow control module 112 and are employed to transmit control signals to and from fluid flow control module 112. Fluid flow control module 112 may be employed to wirelessly communicate with electronic flow control nodes 102, 122, and 124, such as through electromagnetic signals or pressure signals. The well system 10 may benefit from the fiber optic feed through as discussed herein.

Figure 2:
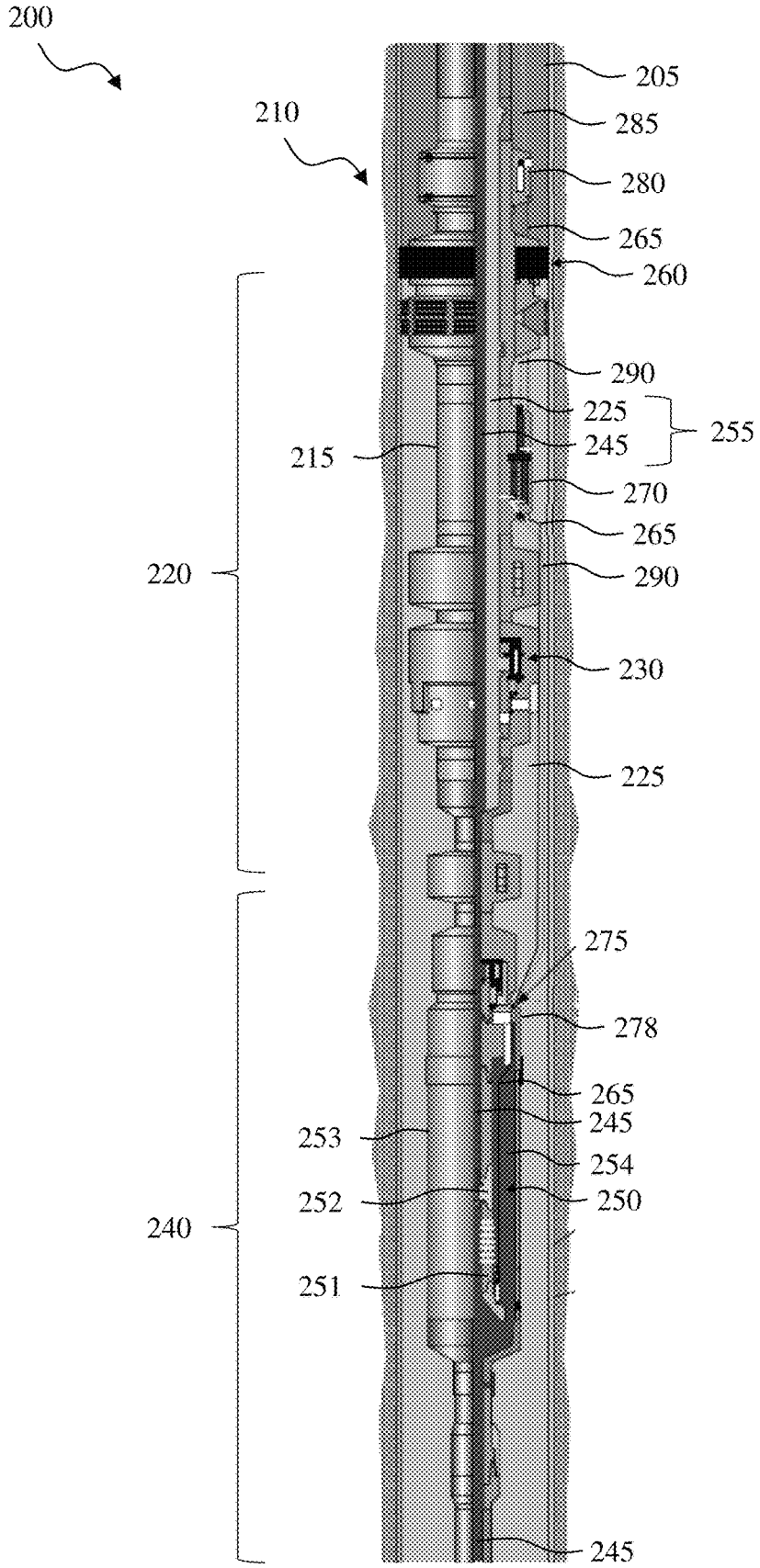
FIGS. 2 through 3E illustrate a well system designed, manufactured, and operated according to one or more alternative embodiments of the disclosure.

Turning to FIG. 2, illustrated is one embodiment of a well system 200 designed, manufactured and/or operated according to one or more embodiments of the disclosure. The well system 200 of FIG. 2, as shown, may be a multi-zone intelligent well system. The well system 200 of FIG. 2 illustrates an embodiment of how each component may interface with each inflow control valve (ICV) and other lower completion accessories, for example with both shrouded and unshrouded ICV's. This method can be duplicated across as many zones as the fiber acquisition unit can support (based on overall length of the fiber optic cable and induced optical losses introduced by splices).

With reference to FIG. 2, the well system 200 includes a wellbore 205 having a completion string 210 (e.g., lower completion) extending through first and second subterranean hydrocarbon producing zones 220, 240. The well system 200, in the illustrated embodiment, additionally includes a feedthrough packer 260 located in the wellbore 205. The feedthrough packer 260, as illustrated in the embodiment of FIG. 2, is configured to help separate a first inflow 225 of hydrocarbons from the first subterranean hydrocarbon producing zone 220 (e.g., uphole subterranean hydrocarbon producing zone) through a first inflow control valve 230 into production tubing 215 from a second inflow 245 of hydrocarbons from the second subterranean hydrocarbon producing zone 240 through a second inflow control valve 250 into the production tubing 215. What may ultimately result in the production tubing 215 above the first and second inflow control valves 230, 250, is comingled flow 255.

The well system 200 of FIG. 2 may additionally include a fiber optic cable 265 installed across the feedthrough packer 260. The fiber optic cable 265, in at least one embodiment, is configured to collect inflow data from (e.g., across in one embodiment) the first subterranean hydrocarbon producing zone 220 or the second subterranean hydrocarbon producing zone 240. In the illustrated embodiment of FIG. 2, the fiber optic cable 265 is configured to collect inflow data from the first subterranean hydrocarbon producing zone 220 and the second subterranean hydrocarbon producing zone 240. Further to the embodiment of FIG. 2, the fiber optic cable 265 is configured to collect inflow data across the first subterranean hydrocarbon producing zone 220 and the second subterranean hydrocarbon producing zone 240.

In the embodiment of FIG. 2, one or more of the first inflow control valve 230 or the second inflow control valve 250 is a shrouded inflow control valve. In the specific embodiment of FIG. 2, the second inflow control valve 250 is a shrouded inflow control valve while the first inflow control valve 230 is not. Accordingly, in at least the embodiment of FIG. 2, the second inflow control valve 250 includes a flow tubing 251 having one or more flow ports 252. The second inflow control valve 250, in the illustrated embodiment, may additionally include a shroud 253 positioned radially about the flow tubing 251. Further to the embodiment of FIG. 2, the fiber optic cable 265 may be located in an annulus 254 between the flow tubing 251 and the shroud 253. Thus, according to the embodiment of FIG. 2, the fiber optic cable 265 is configured to collect inflow data within the shroud 253, if not in certain embodiments across a length of the shroud 253. In one or more embodiments, the fiber optic cable 265 spans an entire length of the first inflow control valve 230 and the second inflow control valve 250, and thus may collect inflow data along a majority of a length of the completion string 210.

Figure 3A:
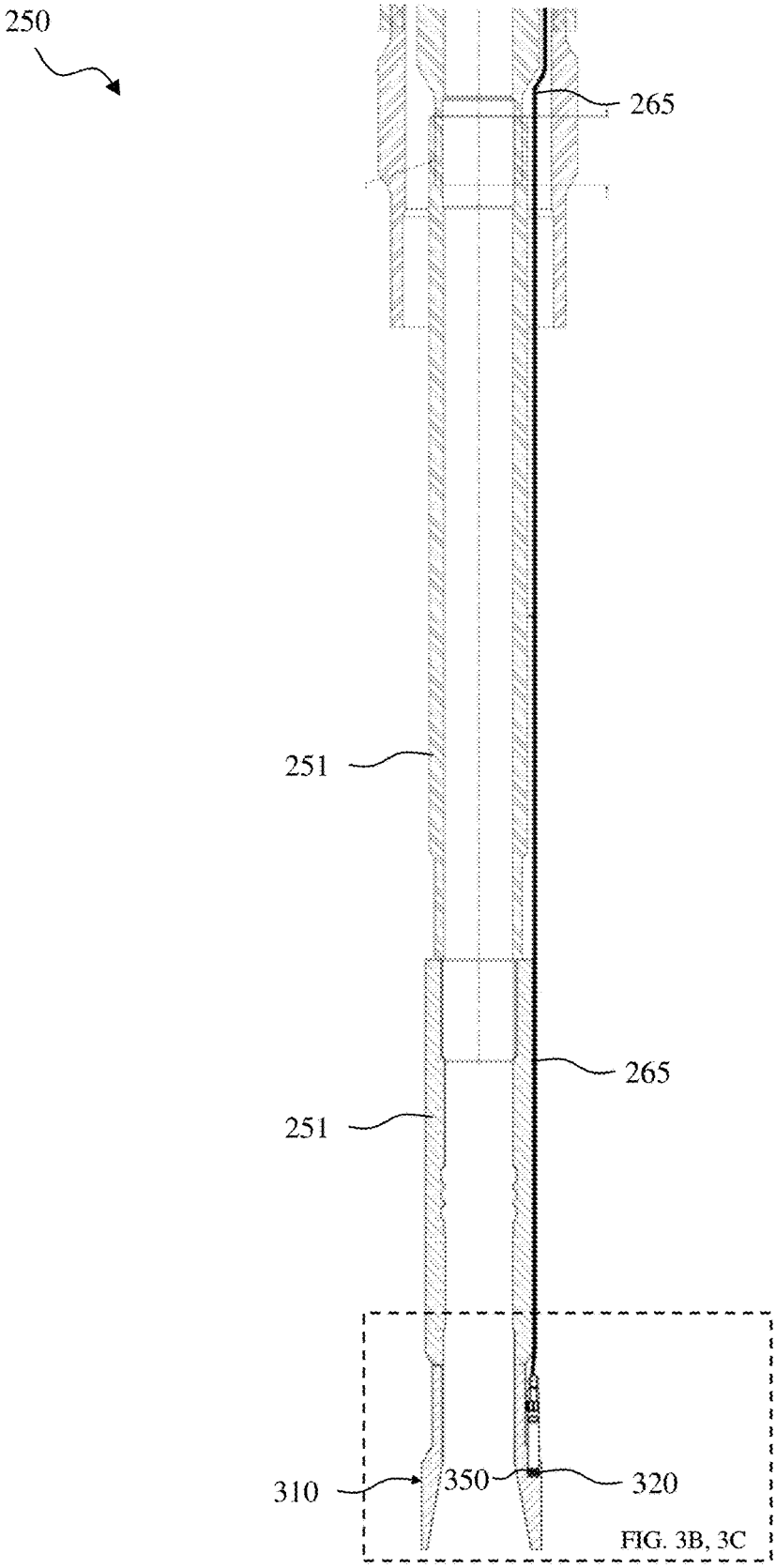
Figure 3B:
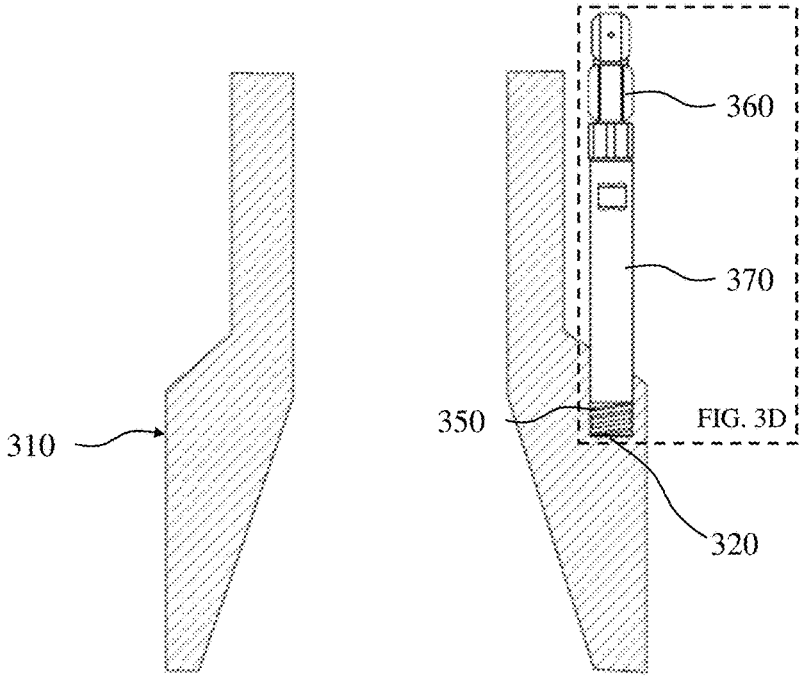
Figure 3C:
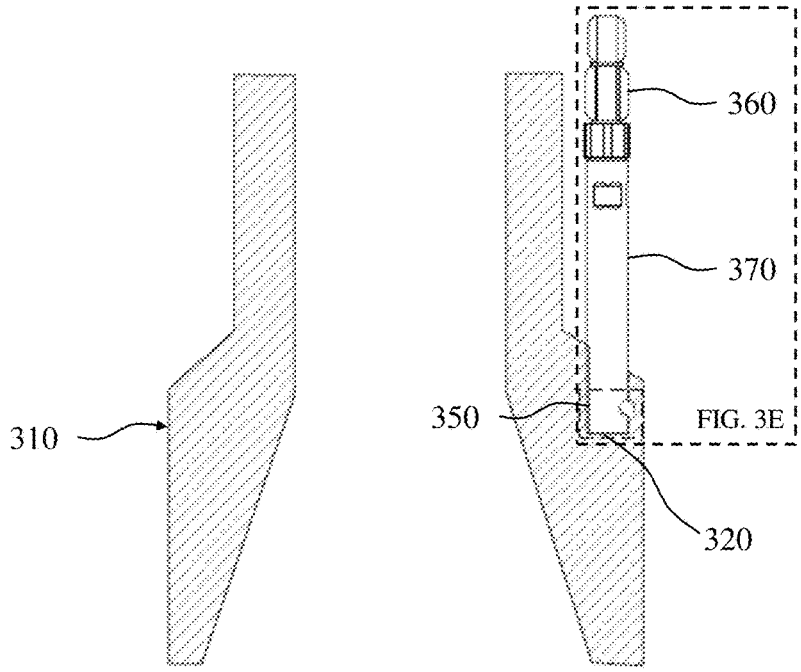
Figure 3D:
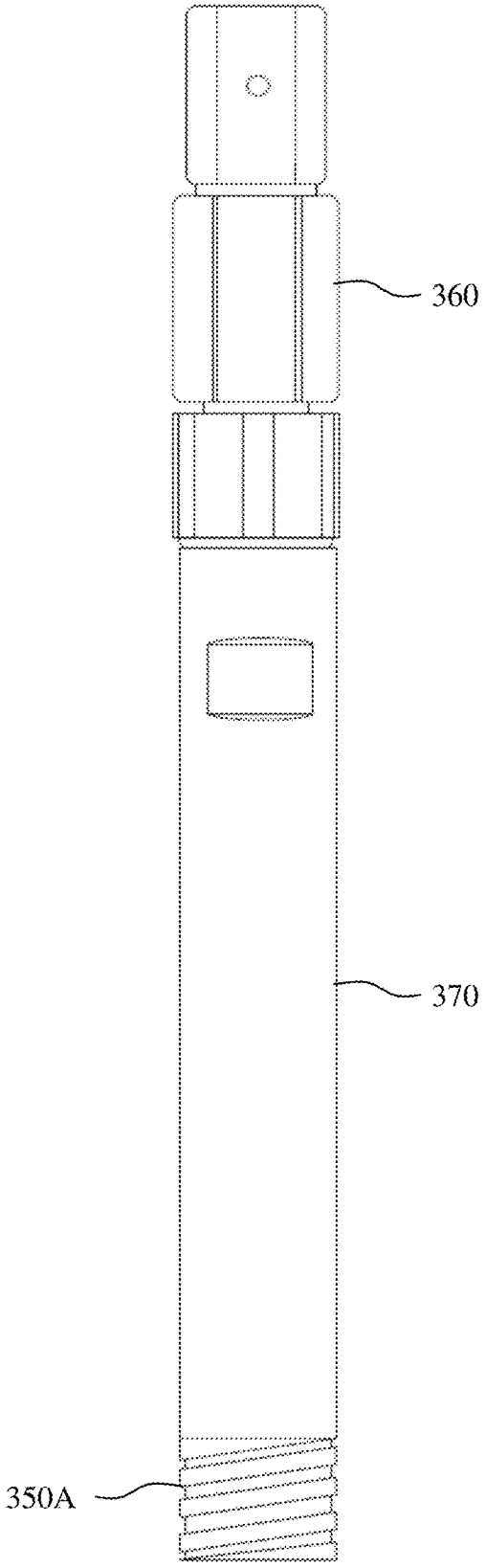

Turning to FIGS. 3A through 3E, illustrated are zoomed in views of portions of the second inflow control valve 250 (e.g., shrouded inflow control valve) of FIG. 2. As shown in FIGS. 3A through 3C, the second inflow control valve 250 may include a flange 310 having a fitting 320 positioned proximate a downhole end of the flow tubing 251. The fitting 320, in the illustrated embodiment, may be coupled end to end with an end connector 350 of the fiber optic cable 265 to fix the fiber optic cable 265 relative to the flow tubing 251. While not specifically shown in FIGS. 3A through 3C, but shown in FIG. 2, the fitting 320 and end connector 350 may be located in the annulus 254 between the flow tube 251 and the shroud 253, among other locations.

With specific reference to FIGS. 3B through 3E, in one or more embodiments, the fiber optic cable 265 is terminated with a connector 360 (e.g., a FMJ connector). Thus, according to this embodiment, a downhole end of the connector 360 may include a termination housing 370 with the end connector 350. As shown in FIGS. 3B through 3E, in certain embodiments the end connector 350 may be a threaded end connector 350A coupled with a threaded fitting (e.g., threaded fitting 320), and in yet other embodiments the end connector 350 may be a pinned end connector 350B coupled with a socket fitting (e.g., socket fitting 320).

Figure 3E:
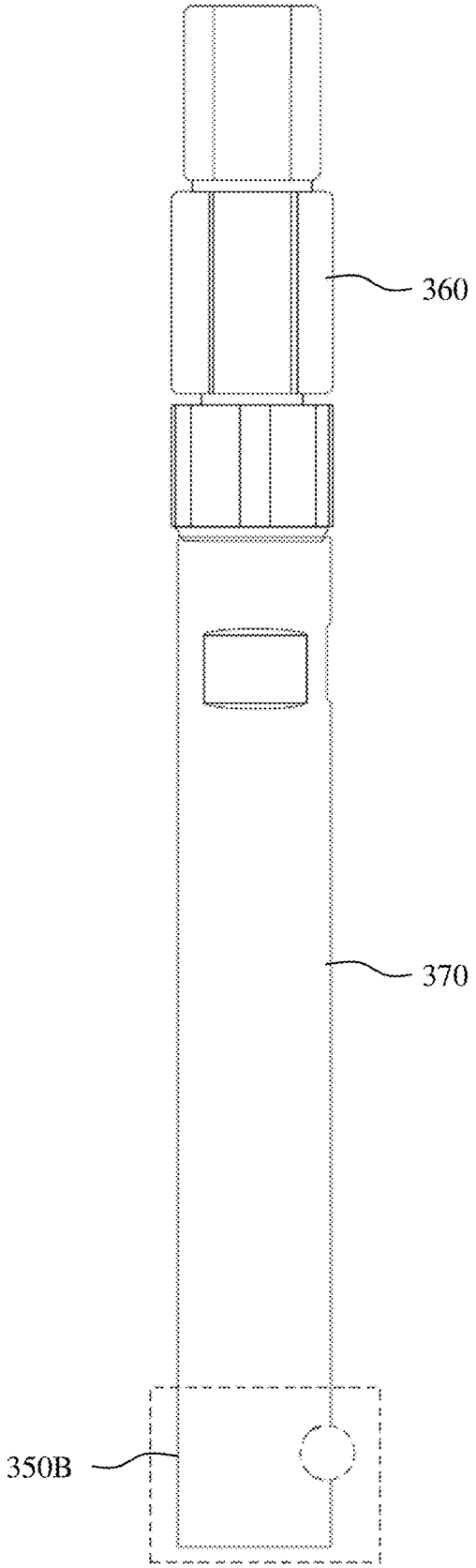

It should be noted that while the flange 310 is illustrated in FIGS. 2 through 3E as being located in the second inflow control valve 250, and specifically located in the annulus 254 between the flow tube 251 and the shroud 253, other embodiments may position the flange 310 in or around the first inflow control valve 230, or anywhere within the completion string 210 shown in FIG. 2.

Referring back to FIG. 2, with continued reference to FIGS. 3A through 3E, the well system 200 may additionally include a gauge mandrel 270 (e.g., smart well gauge mandrel) positioned downhole of the feedthrough packer 260. In at least one embodiment, such as shown, the fiber optic cable 265 bypasses the gauge mandrel 270. The well system 200 of FIG. 2 may additionally include a feed through port 275 (e.g., snorkel port) for allowing the fiber optic cable 265 to enter the annulus 254 created by the shroud 253. It should be noted that if no accommodation exists to pass the fiber optic cable 265 into the annulus 254, an end connector 350 of the fiber optic cable 265 may be secured just above the top of the second inflow control valve 250 (e.g., near point 278). In at least one embodiment, this would ensure that a minimum of 2.5 meters of fiber optic cable 265 would exist between the bottom of the feedthrough packer 260 and the bottom end of the fiber optic cable 265.

The well system 200 may additionally include a splice sub 280 (e.g., compact or hybrid splice sub), which would allow connectivity between an uphole fiber optic cable 285 (e.g., the fiber optic cable above the feedthrough packer 260) and the fiber optic cable 265 below the feedthrough packer 260. In at least one embodiment, the uphole fiber optic cable 285 is a hybrid cable, which could allow for a tubing encapsulated conductor (TEC) 290 to extend below the feedthrough packer 260.

In one or more embodiments, the completion string 210 may be made up outside of the wellbore 205 (e.g., uphole). For example, in at least one embodiment one could make-up the inner string shroud kit components of the second inflow control valve 250. Thereafter, one could secure the end of the fiber optic cable 265 to the flow tubing 251, for example employing the previously described end connector 350 and fitting 320 in the flange 310. Thereafter, the fiber optic cable 265 may be pulled through the shroud 253 with a conveyance (e.g., fish tape). Once the fiber optic cable 265 is secured and positioned within the shroud 253, the remainder of the second inflow control valve 250 may be made up. Thereafter, the additional assemblies above the second inflow control valve 250 (e.g., additional SmartWell® subassemblies) may be made up into a single assy. The fiber optic cable 265 that was previously fed through the second inflow control valve 250 may then be routed across the first inflow control valve 230 and ultimately through the feedthrough packer 260. In at least one embodiment, there is approximately 5 meters or more of armored fiber optic cable secured above the feedthrough packer 260 at or near the splice sub 280 for offshore operations.

In at least one embodiment, for example in an offshore termination, along with the TEC 290 and hydraulic cap tubes that will be spliced to the uphole fiber optic cable 285 prior to picking up the completion string 210, a tail of the fiber optic cable 265 that was secured above the feedthrough packer 260 in the workshop will be cut to length and spliced into the up-hole fiber optic cable 285 and the splice housing secured within the splice sub 280. Since the lower completion 210 is below the rotary, periodic checks may be necessary to be performed to ensure system functionality.

Figure 4:
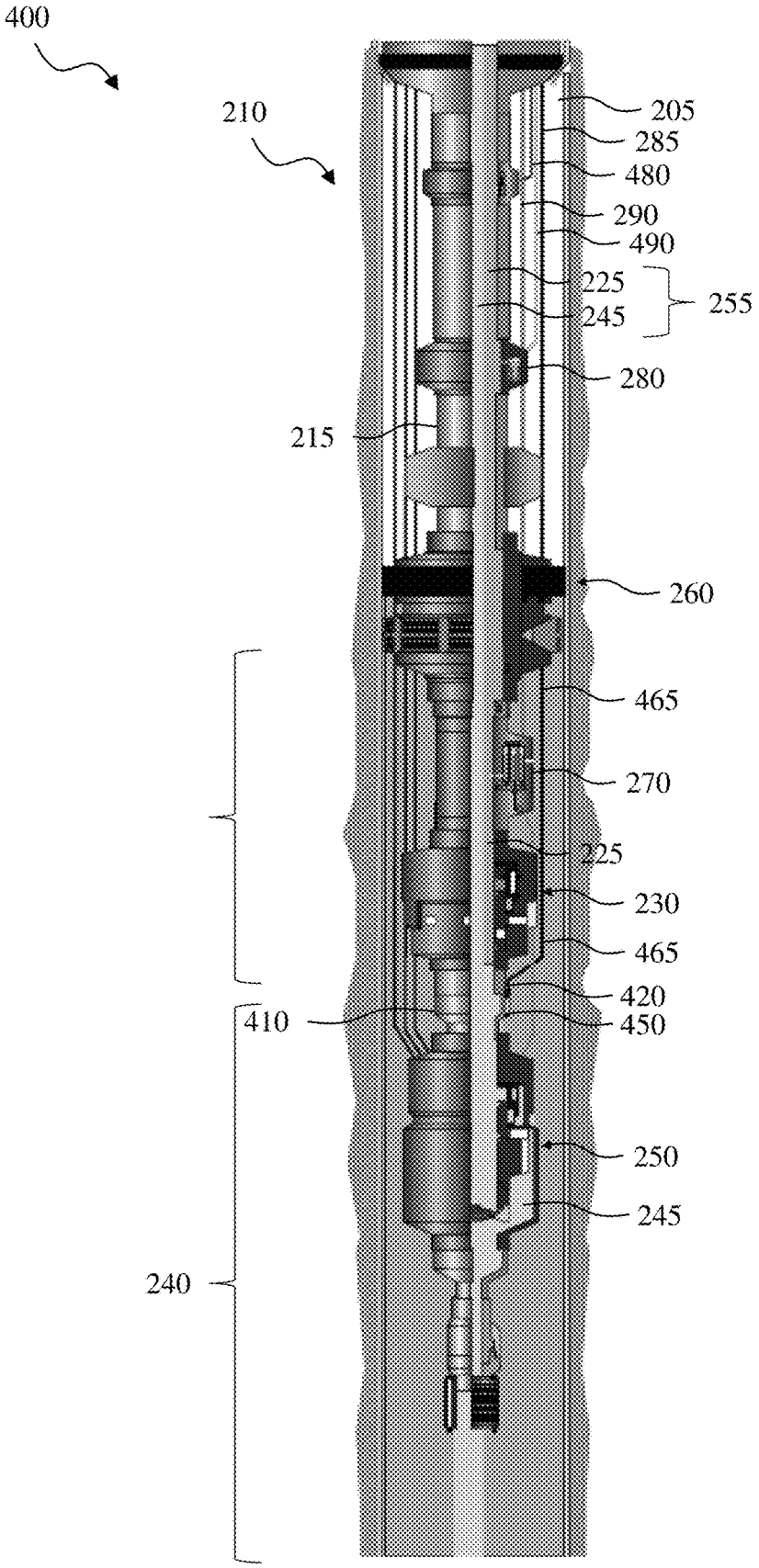
FIG. 4 illustrates a well system designed, manufactured, and operated according to one or more other alternative embodiments of the disclosure.

Turning to FIG. 4, illustrated is an alternative embodiment of a well system 400 designed, manufactured, and/or operated according to one or more embodiments of the disclosure. The well system 400 is similar in certain respects to the well system 200 of FIG. 2. Accordingly, like reference numbers have been used to illustrated similar, if not identical, features. The well system 400 differs, for the most part, from the well system 200, in that the well system 400 employs the first and second inflow control valves 230, 250, but only uses the fiber optic cable 465 to collect inflow data from one of the first or second subterranean hydrocarbon producing zones 220, 240 (e.g., in this instance the first subterranean hydrocarbon producing zone 220). In the illustrated embodiment, the well system 400 includes a flange 410 having a fitting 420, both of which are configured to engage with an end connector 450 coupled to the fiber optic cable 465. The flange 410 and fitting 420 are located between the first inflow control valve 230 and the second inflow control valve 250, for example proximate a lower end of the first inflow control valve 250.

In one or more embodiments, unlike the embodiment of FIG. 2, the single zone fiber optic cable 465 sensing option might not be integrated into the completion string 210 until all sub-assemblies are made up into the final completion string 210. The end connector 350 will be preassembled onto the fiber optic cable 465 and the fiber optic cable 465 will be cut to a length that will allow it to span the entire first hydrocarbon producing zone 220 and fed through the feedthrough packer 260. The fiber optic cable 465 will be secured at the splice sub 280 and the feedthrough packer 260 penetration for the fiber optic cable 265 will be secured and pressure tested, for example with other hydraulic (e.g., control lines 480 and/or chemical injection lines 490) and TEC lines 290.

Figure 5:
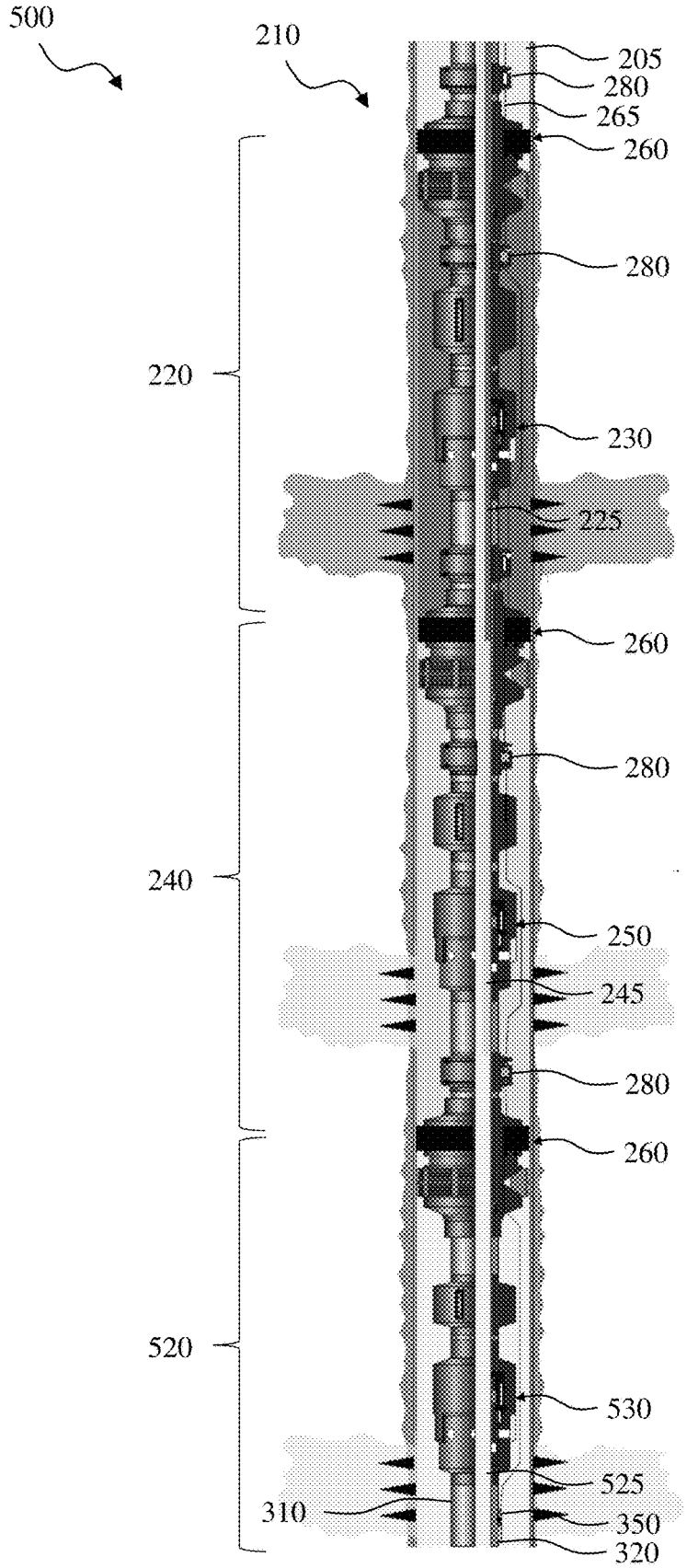
FIG. 5 illustrates a well system designed, manufactured, and operated according to one or more additional alternative embodiments of the disclosure.

Turning to FIG. 5, illustrated is an alternative embodiment of a well system 500 designed, manufactured, and/or operated according to one or more embodiments of the disclosure. The well system 500 is similar in certain respects to the well system 200 of FIG. 2. Accordingly, like reference numbers have been used to illustrated similar, if not identical, features. The well system 500 differs, for the most part, from the well system 200, in that the well system 500 employs a third hydrocarbon producing zone 520, a third inflow 525 and a third inflow control valve 530, in addition to those illustrated in FIG. 2. Further to the embodiment of FIG. 5, the flange 310, fitting 320 and end connector 350 are located downhole of the first and second inflow control valves 230, 250, and particularly proximate a lower end of the third hydrocarbon producing zone 520. Further to the embodiment of FIG. 5, the well system 500 may include multiple feedthrough packers 260, as well as multiple splice subs 280.

In at least one embodiment, the fiber optic cable 265 is installed across the first and second feedthrough packers 260, the fiber optic cable 265 configured to collect inflow data from at least one of the first subterranean hydrocarbon producing zone 220 (e.g., uphole subterranean hydrocarbon producing zone), second subterranean hydrocarbon producing zone 240 (e.g., middle subterranean hydrocarbon producing zone), or third subterranean hydrocarbon producing zone 520 (e.g., downhole subterranean hydrocarbon producing zone). In at least one other embodiment, the fiber optic cable 265 is installed across the first and second feedthrough packers 260, the fiber optic cable 265 configured to collect inflow data from each of the first subterranean hydrocarbon producing zone 220 (e.g., uphole subterranean hydrocarbon producing zone), second subterranean hydrocarbon producing zone 240 (e.g., middle subterranean hydrocarbon producing zone), or third subterranean hydrocarbon producing zone 520 (e.g., downhole subterranean hydrocarbon producing zone).

In one or more embodiments, each zonal isolation and inflow control valve will be made up in the workshop with handling pups above and below. If the rig can handle longer assemblies, each zonal isolation and inflow control valve can be run in tandem, as scope allows. The fiber end connector 350 may be made up and tested in the workshop and installed on the lower-most zonal isolation and inflow assembly (e.g., proximate the third inflow control valve 530 in the embodiment of FIG. 5). The fiber optic cable 365 may be secured to the production tubing 215 of the lower most assembly, fed through the feedthrough packer 260, and a tail of the fiber optic cable 265 will be left above each of the feedthrough packers 260 for offshore operations.

For offshore termination, the lower zone assembly will be made up into the tubing string and the fiber optic cable 265 that will run to the TH will be spliced at the splice clamp above the packer along with any other control lines and cables routed below packer. The fiber optic cable 265 will be spooled across each zone until the splice clamp below each feedthrough packer 260 is reached. At that time, the fiber optic cable 265 being spooled into the wellbore 205 will be cut at the splice clamp location and the uphole section of fiber optic cable 265 will be fed-through the feedthrough packer 260 and spliced. This will be repeated at each zone until above the final production packer.

In at least one embodiment, the existing components may include:

- Fiber optic cable.
- Fiber optic splice assembly (e.g., sub) or a hybrid electro-optical splice assembly (e.g., sub) to allow connectivity between fiber optic cables from below a packer to the fiber optic cable that will be routed up-hole to the tubing hanger.
- Feedthrough packer with the capability to feed one or more control lines through the packer assembly.
- Internal control valve (ICV) with snorkel port and/or unutilized PSA ports for routing cable into zone for shrouded ICV application.
- ICV Shroud Kit, consisting of pup joint, landing nipple, shroud, wireline re-entry guide, and shroud cross-over (XO) which will compose the inner string and the shroud that will isolate lower zone flow from upper zone flow in two zone application.
- Fiber optic cable end termination; if only spanning the upper-most zone of an intelligent completion, the existing end termination will be used as the point in which we terminate the fiber optic cable.
- New/Modified Components: See attached figures.
- When installing a fiber optic cable across an ICV with a shroud, in certain embodiments there needs to be a method of securing the fiber to the inner string created by the shroud kit. Some well operators will not want to introduce a conventional mid-joint clamp into the zone as there is not sufficient run history of these components being exposed to production at high rates. The present disclosure proposes following the designs discussed herein to allow the use of higher end alloys compatible with most conditions that will not impose the same restrictions in the flow path as a clamp will.
- Anchor termination which integrates a threaded end or a pinned socket end to the existing fiber optic cable end termination that will allow anchoring the termination in place, preventing any movement within the shroud.

Anchoring wireline re-entry guide (WLREG), which, by its current construction has a very heavy wall to provide a robust face that will not be damaged when trying to pull a wireline tool back into the smaller tubing ID from the larger ID shroud section. The receptacle for the anchor termination can be machined into the top side of the WLREG to secure the end of fiber to the inner string on a shrouded ICV assembly.

Aspects disclosed herein include:

A. A well system, the well system including: 1) a wellbore extending through first and second subterranean hydrocarbon producing zones; 2) a feedthrough packer located in the wellbore, the feedthrough packer configured to help separate a first inflow of hydrocarbons from the first subterranean hydrocarbon producing zone through a first inflow control valve into production tubing from a second inflow of hydrocarbons from the second subterranean hydrocarbon producing zone through a second inflow control valve into the production tubing; and 3) a fiber optic cable installed across the feedthrough packer, the fiber optic cable configured to collect inflow data from the first subterranean hydrocarbon producing zone or the second subterranean hydrocarbon producing zone.

B. A method, the method including: 1) forming a wellbore through first and second subterranean hydrocarbon producing zones; and 2) positioning a lower completion within the wellbore, the lower completion including: a) a feedthrough packer located in the wellbore; b) production tubing located in the wellbore, the production tubing including a first inflow control valve configured to regulate a first inflow of hydrocarbons from the first subterranean hydrocarbon producing zone into the production tubing, and a second inflow control valve configured to regulate a second inflow of hydrocarbons from the second subterranean hydrocarbon producing zone into the production tubing, the feedthrough packer configured to help separate the first inflow and the second inflow prior to entering the production tubing; and c) a fiber optic cable installed across the feedthrough packer, the fiber optic cable configured to collect inflow data from the first subterranean hydrocarbon producing zone or the second subterranean hydrocarbon producing zone.

C. A well system, the well system including: 1) a wellbore extending through a subterranean hydrocarbon producing zone; 2) production tubing located in the wellbore, the production tubing including a first inflow control valve configured to regulate a first inflow of hydrocarbons from the subterranean hydrocarbon producing zone into the production tubing; 3) a flange coupled to the production tubing and having a fitting positioned proximate a downhole end thereof; and 4) a fiber optic cable installed within the wellbore, an end connector of the fiber optic cable coupled end to end with the fitting of the flange to fix the fiber optic cable relative to the first inflow control valve.

D. A method, the method including; 1) forming a wellbore through a subterranean hydrocarbon producing zone; and 2) positioning a lower completion within the wellbore, the lower completion including: a) production tubing located in the wellbore, the production tubing including a first inflow control valve configured to regulate a first inflow of hydrocarbons from the subterranean hydrocarbon producing zone into the production tubing; b) a flange coupled to the production tubing and having a fitting positioned proximate a downhole end thereof; and c) a fiber optic cable installed within the wellbore, an end connector of the fiber optic cable coupled end to end with the fitting of the flange to fix the fiber optic cable relative to the first inflow control valve.

Aspects A, B, C and D may have one or more of the following additional elements in combination: Element 1: wherein the fiber optic cable is configured to collect inflow data from the first subterranean hydrocarbon producing zone and the second subterranean hydrocarbon producing zone. Element 2: wherein the fiber optic cable is configured to collect inflow data across the first subterranean hydrocarbon producing zone or the second subterranean hydrocarbon producing zone. Element 3: wherein the fiber optic cable is configured to collect inflow data across the first subterranean hydrocarbon producing zone and the second subterranean hydrocarbon producing zone. Element 4: wherein the wellbore extends through a third hydrocarbon producing zone, the first hydrocarbon producing zone being an uphole hydrocarbon producing zone, the second hydrocarbon producing zone being a middle hydrocarbon producing zone, and the third hydrocarbon producing zone being a downhole hydrocarbon producing zone, and further including a second feedthrough packer located in the wellbore, the second feedthrough packer configured to help separate a third inflow of hydrocarbons from the third downhole hydrocarbon producing zone through a third inflow control valve into the production tubing from the first a second inflow of hydrocarbons into the production tubing. Element 5: wherein the fiber optic cable is installed across the first and second feedthrough packers, the fiber optic cable configured to collect inflow data from at least one of the uphole subterranean hydrocarbon producing zone, middle subterranean hydrocarbon producing zone, or downhole subterranean hydrocarbon producing zone. Element 6: wherein the fiber optic cable is installed across the first and second feedthrough packers, the fiber optic cable configured to collect inflow data from each of the uphole subterranean hydrocarbon producing zone, middle subterranean hydrocarbon producing zone, and downhole subterranean hydrocarbon producing zone. Element 7: wherein the first inflow control valve or the second inflow control valve is a shrouded inflow control valve including a flow tubing having one or more flow ports and a shroud positioned radially about the flow tubing, and further wherein the fiber optic cable is located in an annulus between the flow tubing and the shroud. Element 8: wherein the fiber optic cable is configured to collect inflow data across a length of the shroud. Element 9: wherein the flow tubing includes a flange having a fitting positioned proximate a downhole end thereof, the fitting coupled end to end with an end connector of the fiber optic cable to fix the fiber optic cable relative to the flow tubing. Element 10: wherein the fitting is located in the annulus between the flow tube and the shroud. Element 11: wherein the fiber optic cable is terminated with an FMJ connector, and further wherein a downhole end of the FMJ connector includes a termination housing with the end connector. Element 12: wherein the end connector is a threaded end connector coupled with a threaded fitting. Element 13: wherein the end connector is a pinned end connector coupled with a socket fitting. Element 14: further including a gauge mandrel positioned downhole of the feedthrough packer, and further wherein the fiber optic cable bypasses the gauge mandrel. Element 15: wherein the fiber optic cable spans an entire length of the first inflow control valve and the second inflow control valve. Element 16: wherein the fiber optic cable is terminated with an FMJ connector, and further wherein a downhole end of the FMJ connector includes a termination housing with the end connector. Element 17: wherein the end connector is a threaded end connector coupled with a threaded fitting. Element 18: wherein the end connector is a pinned end connector coupled with a socket fitting. Element 19: wherein the first inflow control valve is a shrouded inflow control valve including a flow tubing having one or more flow ports and a shroud positioned radially about the flow tubing, and further wherein the fiber optic cable is located in an annulus between the flow tubing and the shroud. Element 20: wherein the fiber optic cable is configured to collect inflow data across a length of the shroud. Element 21: wherein the flange forms at least a portion of the flow tubing. Element 22: wherein the fitting is located in the annulus between the flow tube and the shroud. Element 23: wherein the subterranean hydrocarbon producing zone is a first subterranean hydrocarbon producing zone, and further wherein the wellbore extends through a second subterranean hydrocarbon producing zone, the feedthrough packer configured to help separate the first inflow of hydrocarbons from the first subterranean hydrocarbon producing zone through the first inflow control valve into the production tubing from a second inflow of hydrocarbons from the second subterranean hydrocarbon producing zone through a second inflow control valve into the production tubing, and further wherein the flange is located downhole of the first inflow control valve and at least partially downhole of the second inflow control valve. Element 24: further including a feedthrough packer located in the wellbore, the feedthrough packer configured to help guide the first inflow of hydrocarbons from the subterranean hydrocarbon producing zone through the first inflow control valve and into the production tubing, the fiber optic cable installed across the feedthrough packer.

Those skilled in the art to which this application relates will appreciate that other and further additions, deletions, substitutions and modifications may be made to the described embodiments.

What is claimed is:

1. A well system, comprising:

a wellbore extending through a subterranean hydrocarbon producing zone;

production tubing located in the wellbore, the production tubing including a first inflow control valve configured to regulate a first inflow of hydrocarbons from the subterranean hydrocarbon producing zone into the production tubing;

a flange coupled to the production tubing and having a fitting positioned proximate a downhole end thereof; and a fiber optic cable installed within the wellbore, an end connector of the fiber optic cable coupled end to end with the fitting of the flange to fix the fiber optic cable relative to the first inflow control valve, wherein the fiber optic cable is terminated with a connector, and further wherein a downhole end of the connector includes a termination housing with the end connector.

2. The well system as recited in claim 1, wherein the end connector is a threaded end connector coupled with a threaded fitting.

3. The well system as recited in claim 1, wherein the end connector is a pinned end connector coupled with a socket fitting.

4. The well system as recited in claim 1, wherein the first inflow control valve is a shrouded inflow control valve including a flow tubing having one or more flow ports and a shroud positioned radially about the flow tubing, and further wherein the fiber optic cable is located in an annulus between the flow tubing and the shroud.

5. The well system as recited in claim 4, wherein the fiber optic cable is configured to collect inflow data across a length of the shroud.

6. The well system as recited in claim 4, wherein the flange forms at least a portion of the flow tubing.

7. The well system as recited in claim 6, wherein the fitting is located in the annulus between the flow tube and the shroud.

8. The well system as recited in claim 1, wherein the subterranean hydrocarbon producing zone is a first subterranean hydrocarbon producing zone, and further wherein the wellbore extends through a second subterranean hydrocarbon producing zone, a feedthrough packer configured to help separate the first inflow of hydrocarbons from the first subterranean hydrocarbon producing zone through the first inflow control valve into the production tubing from a second inflow of hydrocarbons from the second subterranean hydrocarbon producing zone through a second inflow control valve into the production tubing, and further wherein the flange is located downhole of the first inflow control valve and at least partially downhole of the second inflow control valve.

9. The well system as recited in claim 1, further including a feedthrough packer located in the wellbore, the feedthrough packer configured to help guide the first inflow of hydrocarbons from the subterranean hydrocarbon producing zone through the first inflow control valve and into the production tubing, the fiber optic cable installed across the feedthrough packer.

10. A method, comprising:

forming a wellbore through a subterranean hydrocarbon producing zone; and positioning a completion string within the wellbore, the completion string including:

production tubing located in the wellbore, the production tubing including a first inflow control valve configured to regulate a first inflow of hydrocarbons from the subterranean hydrocarbon producing zone into the production tubing;

a flange coupled to the production tubing and having a fitting positioned proximate a downhole end thereof; and a fiber optic cable installed within the wellbore, an end connector of the fiber optic cable coupled end to end with the fitting of the flange to fix the fiber optic cable relative to the first inflow control valve, wherein the fiber optic cable is terminated with a connector, and further wherein a downhole end of the connector includes a termination housing with the end connector.

11. The method as recited in claim 10, wherein the end connector is a threaded end connector coupled with a threaded fitting.

12. The method as recited in claim 10, wherein the end connector is a pinned end connector coupled with a socket fitting.

13. The method as recited in claim 10, wherein the first inflow control valve is a shrouded inflow control valve including a flow tubing having one or more flow ports and a shroud positioned radially about the flow tubing, and further wherein the fiber optic cable is located in an annulus between the flow tubing and the shroud.

14. The method as recited in claim 13, wherein the fiber optic cable is configured to collect inflow data across a length of the shroud.

15. The method as recited in claim 13, wherein the flange forms at least a portion of the flow tubing.

16. The method as recited in claim 15, wherein the fitting is located in the annulus between the flow tube and the shroud.

17. The method as recited in claim 10, wherein the flange is located downhole of the first inflow control valve.

18. The method as recited in claim 10, wherein the subterranean hydrocarbon producing zone is a first subterranean hydrocarbon producing zone, and further wherein the wellbore extends through a second subterranean hydrocarbon producing zone, a feedthrough packer configured to help separate the first inflow of hydrocarbons from the first subterranean hydrocarbon producing zone through the first inflow control valve into the production tubing from a second inflow of hydrocarbons from the second subterranean hydrocarbon producing zone through a second inflow control valve into the production tubing, and further wherein the flange is located downhole of the first inflow control valve and at least partially downhole of the second inflow control valve.

19. The method as recited in claim 10, further including a feedthrough packer located in the wellbore, the feedthrough packer configured to help guide the first inflow of hydrocarbons from the subterranean hydrocarbon producing zone through the first inflow control valve and into the production tubing, the fiber optic cable installed across the feedthrough packer.

* * * * *